US007407240B2

(12) United States Patent
Collins et al.

(10) Patent No.: US 7,407,240 B2
(45) Date of Patent: Aug. 5, 2008

(54) NOTCHED MULLION RETAINER ARRANGEMENT FOR A REFRIGERATOR CABINET

(75) Inventors: Clint J. Collins, Bondurant, IA (US); David J. Olberding, Cedar Rapids, IA (US); Jonathan J. Tiemeier, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 318 days.

(21) Appl. No.: 11/033,532

(22) Filed: Jan. 12, 2005

(65) Prior Publication Data

US 2006/0152126 A1 Jul. 13, 2006

(51) Int. Cl.
*A47B 96/00* (2006.01)

(52) U.S. Cl. ..... 312/407; 312/406.2

(58) Field of Classification Search ..... 312/257.1, 312/263, 265.5, 265.6, 407, 401, 406.2, 406; 220/592.01, 592.02, 592.09, 592.1; 62/277, 62/440

See application file for complete search history.

(56) References Cited

U.S. PATENT DOCUMENTS 2,708,088 A * 5/1955 Steinke ..... 248/221.12
3,141,645 A * 7/1964 Hayden ..... 248/188
3,186,782 A * 6/1965 Ullman, Jr. ..... 312/263
3,619,482 A 11/1971 Boor
3,835,660 A 9/1974 Franck
3,868,152 A 2/1975 Dixon
3,933,398 A 1/1976 Haag
3,942,853 A 3/1976 Grimm et al.
3,984,223 A 10/1976 Whistler, Jr.
3,989,329 A 11/1976 Benford
4,120,550 A 10/1978 Sherburn
4,150,518 A 4/1979 Truesdell et al.
4,170,391 A 10/1979 Bottger
4,330,310 A 5/1982 Tate, Jr. et al.
4,348,068 A 9/1982 Hawkins et al.
4,496,072 A 1/1985 Fleck
4,548,049 A 10/1985 Rajgopal
4,550,576 A 11/1985 Tate, Jr. et al.
4,558,503 A 12/1985 Wilson
4,765,696 A 8/1988 Cordill et al.
4,801,181 A 1/1989 Cordill et al.
4,821,399 A 4/1989 Markley et al.
4,862,577 A 9/1989 Cordill et al.
4,884,415 A 12/1989 Mandel et al.
4,914,341 A 4/1990 Weaver et al.
4,941,289 A 7/1990 Rolek
4,955,676 A 9/1990 Weaver et al.
5,033,182 A 7/1991 Winterheimer et al.
5,174,640 A 12/1992 Kuwahara et al.

(Continued)

*Primary Examiner*—Janet M Wilkens
(74) *Attorney, Agent, or Firm*—Kirk Goodwin; Michael D. Lafrenz

(57) ABSTRACT

A mullion is attached to a cabinet shell of a refrigerator through the use of a retainer that includes a laterally extending portion positioned between primary and secondary flanges of the cabinet shell, and a longitudinally extending portion that is interengaged with additional flange structure defined by the mullion. Clips formed on the retainer engage wall portions formed by the mullion flange structure to secure the retainer to the mullion. A tab formed on the retainer engages a keyhole formed in the secondary flange of the cabinet shell, thereby aiding in securing the retainer to the cabinet and preventing the mullion from undesirably shifting in either a horizontal or vertical manner.

16 Claims, 4 Drawing Sheets

U.S. PATENT DOCUMENTS

| | | | | |
|---|---|---|---|---|
| 5,255,531 | A | 10/1993 | Williams et al. | |
| 5,349,832 | A | 9/1994 | Johnson et al. | |
| 5,584,551 | A | 12/1996 | Jenkins | |
| 5,645,330 | A | 7/1997 | Artwohl et al. | |
| 5,720,536 | A | 2/1998 | Jendkins et al. | |
| 5,725,294 | A | 3/1998 | Froelicher | |
| 5,992,960 | A | 11/1999 | Wolanin | |
| 6,036,292 | A | 3/2000 | Mandel et al. | |
| 6,393,855 | B1 * | 5/2002 | Schuchert et al. | 62/277 |
| 6,489,566 | B1 * | 12/2002 | Durin | 174/135 |
| 7,014,283 | B2 * | 3/2006 | Grace et al. | 312/406 |

* cited by examiner

NOTCHED MULLION RETAINER ARRANGEMENT FOR A REFRIGERATOR CABINET

BACKGROUND OF THE INVENTION

1. Field of the Invention

The present invention generally relates to a refrigerated cabinet and, more specifically, to the mounting of a mullion extending along a partition between two compartments of a refrigerator cabinet.

2. Discussion of the Prior Art

A conventional refrigerator cabinet is defined by insulated freezer and fresh food compartments which are disposed in either a side-by-side or a vertically spaced configuration. Generally, integrally molded fresh food and freezer liners are used for defining interior storage compartments of the cabinet. More specifically, the conventional refrigerator cabinet is typically defined by an outer shell that is formed from sheet metal to which is attached, at a front face portion thereof, a mullion that partitions the shell into two section. Each of the fresh food and freezer liners are inserted into a respective cabinet section before being mated with return flange portions of both the cabinet shell and the mullion. FIG. 1 illustrates, in a cross-sectional view, a typical prior art side-by-side refrigerator cabinet front flange design and the manner in which a mullion is typically attached thereto. As shown in FIG. 1, the side-by-side refrigerator cabinet includes an outer metal shell 3' having a top panel portion that is bent, typically through a roll-forming process, so as to define a front face primary flange 47'. The cabinet shell 3' returns sharply back behind the primary flange 47' and is again roll-formed to create secondary flange 61' that is spaced from the primary flange 47' by a cavity.

A mullion 11' is provided at an upper end portion thereof with a slight bend so that it may abut against the primary flange 47', while the terminal end extends within the cavity defined between the primary and secondary flanges 47' and 61'. As clearly shown in FIG. 1, the primary flange 47' supports the mullion 11' in one direction, i.e., it limits movement of the mullion 11' in a direction away from the secondary flange 61'. A yoder tube (not shown) is often positioned between the upper terminal end of the mullion 11' and the secondary flange 61' in order to prevent the mullion 11' from moving in a direction away from the primary flange 47'. Of course, as is known in the art, the yoder tube is designed to run along the mullion 11' and provides an inexpensive and efficient heat transfer arrangement whereby the heat of condensation of the hot refrigeration gases is used to prevent condensation of moisture adjacent the front door openings of the freezer and fresh food compartments.

There are several problems associated with this prior art configuration. For instance, unless additional attachment steps are taken, the only member preventing the mullion 11' from moving away from the primary flange 47' is the arrangement of the yoder tube between the mullion 11' and the secondary flange 61'. Often the yoder tube cannot sufficiently retain the mullion 11' in the desired position and the mullion 11' moves away from the primary flange 47' such that a non-flush assembly is created between the parts. In addition, unless extreme tolerances are maintained, there is nothing to stop the mullion 11' from sliding downward along the primary flange 47' to create a gap between the terminal edge of the primary flange 47' and the bent portion of the mullion 11'. There is also nothing that prevents the mullion 11' from shifting sideways within the gap between primary flange 47' and secondary flange 61', at least until liners are inserted into cabinet shell 3'. Not only is such a poorly fitted part unsightly, but it can create problems when the refrigerator cabinet is insulated in the wall spaces between the liners and the outer shell 3'. More specifically, once the mullion 11', yoder tube and cabinet liners are in place, foamed insulation is injected between the cabinet shell 3' and the liners and the insulation will tend to leak during the foaming process if there is any vertical gap between the cabinet shell 3' and mullion 11', the mullion 11' shifts sideways or the mullion 11' shifts in the direction of secondary flange 61'.

Based on the above, there exists a need in the art for an improved arrangement for attaching a mullion to the return flange portion of a refrigerator cabinet shell. More specifically, there exists a need for an retainer arrangement which will securely hold the mullion in place, while providing for a flush connection between the cabinet shell and the mullion, in order to prevent horizontal or vertical shifting of the mullion and reduce or eliminate foam leakage during the cabinet foaming process.

SUMMARY OF THE INVENTION

The present invention is directed an improved mullion retainer for interconnecting the outer shell of a refrigerator cabinet and a refrigerator mullion. The refrigerator includes at least one liner positioned within the cabinet shell in order to define laterally spaced fresh food and freezer compartments separated by a fore-to-aft extending divider wall, with a mullion provided at the front of the divider wall. The outer cabinet shell includes a return flange configuration defining a front facing primary flange and a secondary flange, with the primary and secondary flanges being separated by a cavity or gap.

The mullion retainer of the present invention is formed with two longitudinally extending legs that mate with return flange portions of the mullion. The retainer further includes a laterally extending portion adapted to be received in the cavity between the primary and secondary flanges of the cabinet shell, and a tab that cooperates with a keyhole notch in the secondary flange. The tab helps secure the retainer to the cabinet shell, and prevents both horizontal and vertical movement of the mullion with respect to the cabinet.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
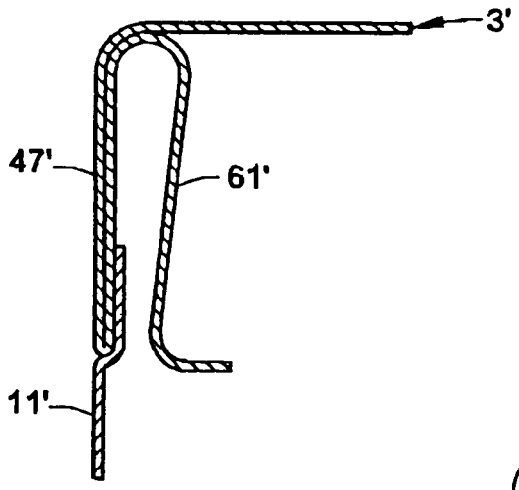
FIG. 1 (PRIOR ART)
FIG. 1 is a partial, cross-sectional view of a mullion to cabinet shell connection utilized in a prior art refrigerator design.
Figure 2:
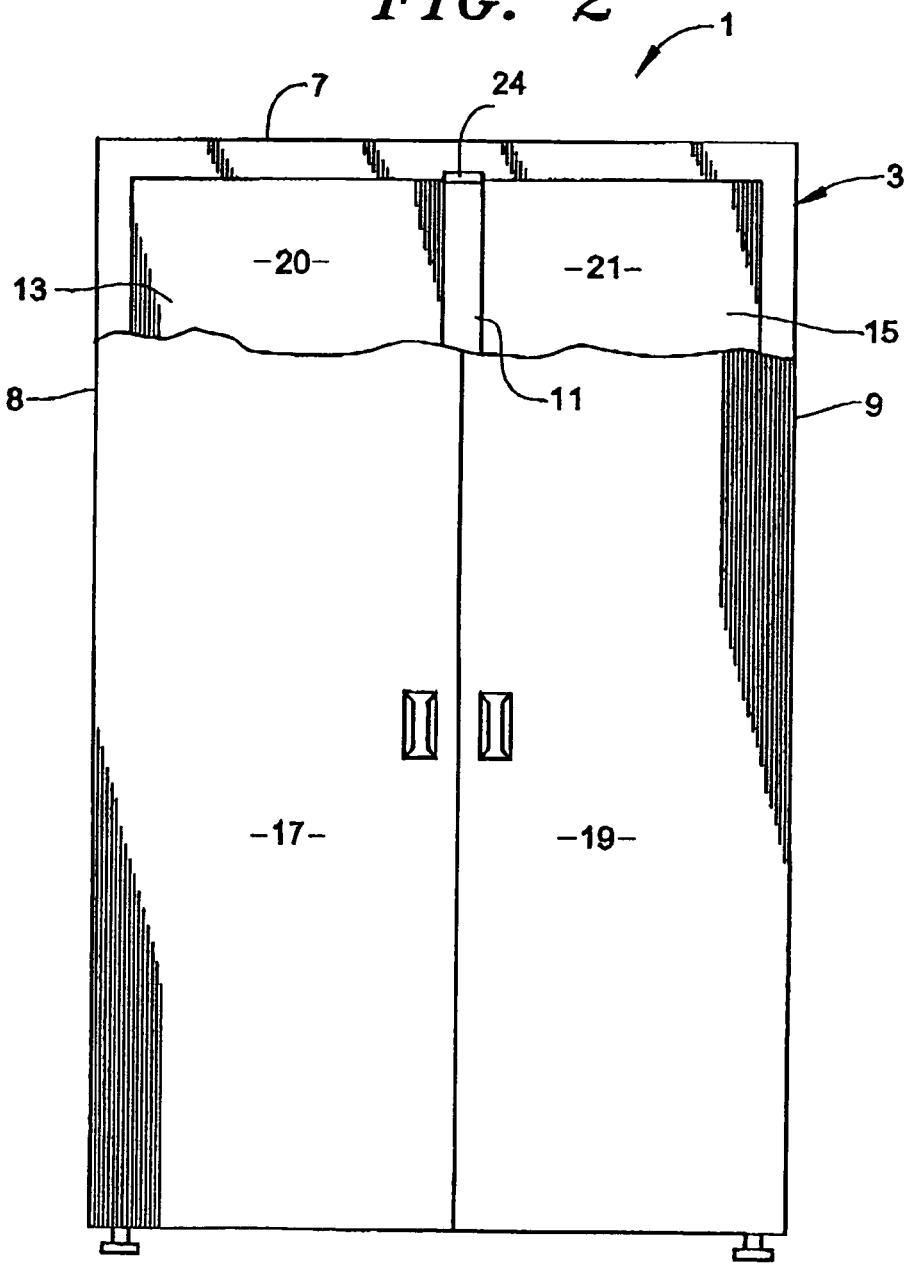
FIG. 2 is a front plan view of a side-by-side refrigerator, shown with upper portions of the doors of the fresh food and freezer compartments being cut-away to reveal the mullion and mullion retainer of the present invention.

With initial reference to FIG. 2, a preferred embodiment of the mullion retainer arrangement of the present invention is shown for use in a side-by-side refrigerator cabinet 1. In a manner known in the art, cabinet 1 has an outer shell 3 that includes a top panel 7, a pair of opposed side panels 8 and 9 and a rear panel (not shown). A vertically extending partition in the form of a mullion 11 is provided adjacent the front of cabinet 1 and aids in dividing the interior of cabinet 1 into a freezer compartment 13 and a fresh food compartment 15. As shown, freezer compartment 13 is provided with a door 17 that is hinged at the outer edge of cabinet 1 for swinging movement about a vertical pivot axis and fresh food compartment 15 is likewise provided with a similar door 19 that is also hinged along an opposed edge of cabinet 1 for swinging movement about a vertical pivot axis. The freezer and fresh food compartments 13 and 15 are defined by a pair of spaced liners 20 and 21 that are mounted within cabinet 1. As the general construction and mounting of doors 17 and 19, as well as liners 20 and 21, are known in the art and are not considered part of the present invention, they will not be further discussed herein. Instead, the present invention is directed to the manner in which mullion 11 is interconnected to cabinet shell 1 through the use of a mullion retainer 24, the construction and manner of use of which will be detailed more fully below.

Figure 3:
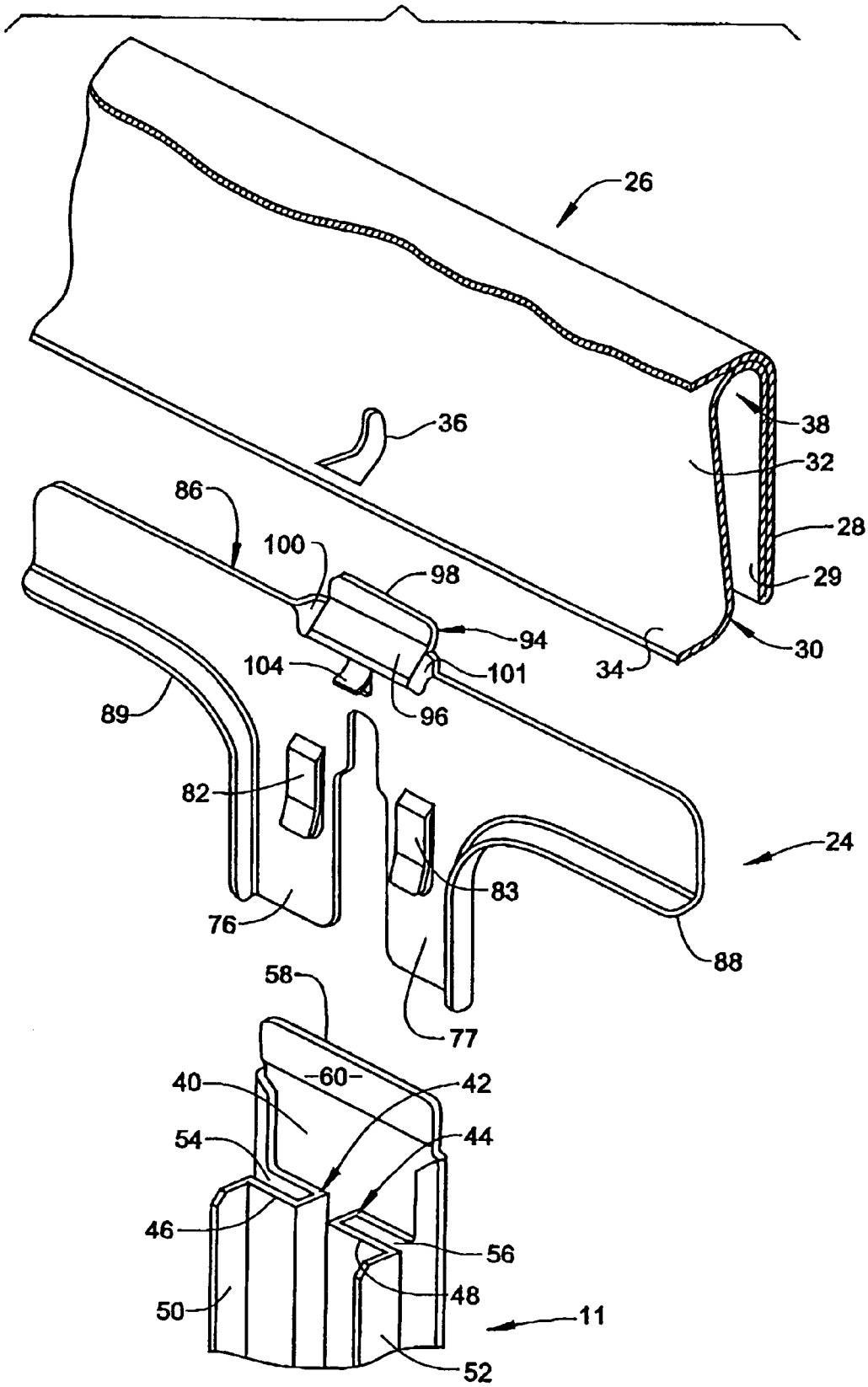
FIG. 3 is a partial, rear exploded view of the cabinet shell return flange, mullion and mullion retainer of the side-by-side refrigerator of FIG. 2.

FIG. 3 will now be referenced in describing the preferred construction of cabinet 1 and mullion 11 which facilitates their interconnection through mullion retainer 24. Top panel 7 of outer shell 3 is bent to form flange structure 26 which defines a front facing primary flange 28, a return flange 29 and a secondary flange 30. Secondary flange 30 includes a main portion 32 and a lip portion 34 extending substantially perpendicularly from main portion 32. A keyhole cut-out 36 is formed in the secondary flange 30 and extends across main portion 32 and lip portion 34. The space between primary and secondary flanges 28 and 30 defines a gap 38.

Preferably, mullion 11 is formed of steel to include a planar body portion 40 and reverse flange structure generally indicated at 42 and 44. Reversing flange structures 42 and 44 have oppositely directed configurations and include wall portions 46 and 48 extending substantially parallel to planar body portion 40, and wall extensions 50 and 52 projecting substantially perpendicularly to planar body portion 40. With this construction, reversing flange structures 42 and 44 define a pair of elongated slots or channels 54 and 56, with slots 54 and 56 being adapted to receive flange portions (not shown) of fresh food liners 20 and 21, respectively. Of course, this interconnection between mullion 11 and liners 20 and 21 occurs after mullion 11 is attached to cabinet 1. Mullion 11 also includes a lip 58 extending from planar body portion 40 such that a rearwardly facing surface 60 and a front facing surface 62 of lip 58 are slightly offset from planar body portion 40 towards reversing flange structures 42 and 44.

Figure 4:
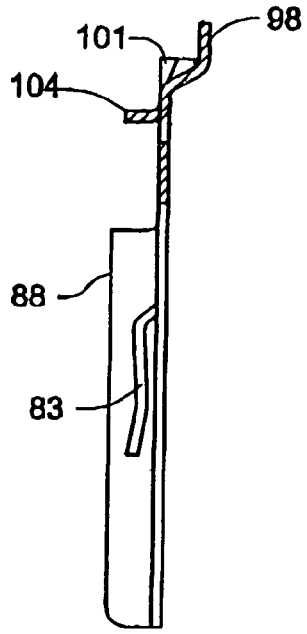
FIG. 4 is a cross-section side view of the mullion retainer of FIG. 3.

Reference will now be made to FIG. 3 in describing the preferred construction of mullion retainer 24. Mullion retainer 24 includes two longitudinally extending members or legs 76 and 77 that generally extend in a first axial direction. Longitudinally extending members 76 and 77 include respective retaining clips 82 and 83. Longitudinally extending members 76 and 77 are integrally formed with a laterally extending portion 86 that extends transverse to the first axial direction. Mullion retainer 24 also includes flanges 88 and 89 that extend along sections of both portion 86 and longitudinally extending members 76 and 77, mainly for structural integrity and positioning purposes. Extending in the first axial direction and offset from body section 86 is a finger member 94. Finger member 94 includes a sloping portion 96 that leads to an upstanding portion 98. Bent rim portions 100 and 101 are formed by the transition of planar body section 86 to sloping portion 96. Additionally, as clearly shown in FIGS. 3 and 4, a small punched-out tab 104 extends substantially perpendicularly from planar body section 86, below finger member 94.

Figure 5:
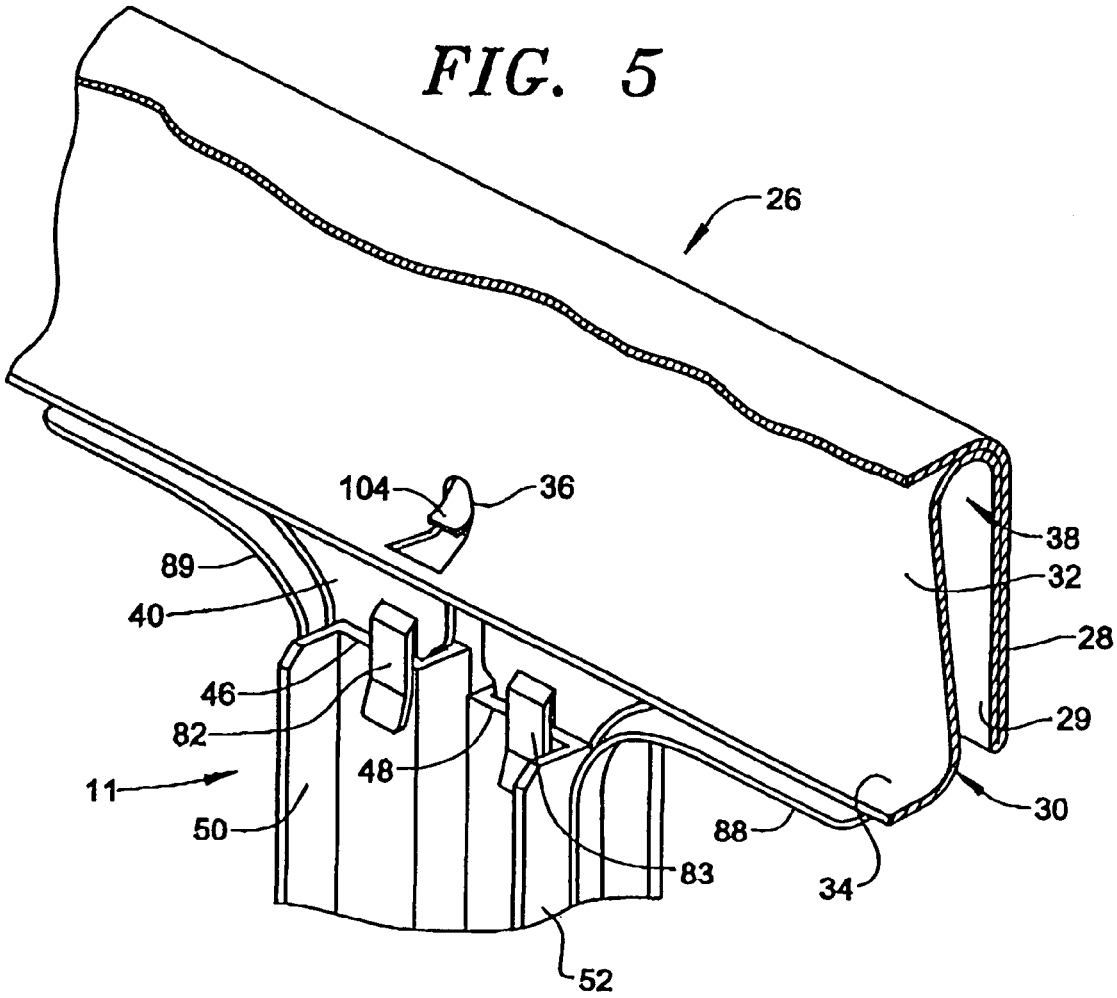
FIG. 5 is a rear perspective view of the assembled mullion retaining arrangement of FIG. 3.

The manner is which mullion retainer 24 interconnects flange structure 26 and mullion 11 will now be discussed. Elongated slots 54 and 56 of mullion 11 are sized to spaciously receive longitudinally extending members 76 and 77 of retainer 24. As depicted in FIG. 5, when longitudinally extending members 76 and 77 are inserted into slots 54 and 56, clips 82 and 83 extend over wall portions 46 and 48 of mullion 11, respectively. In this manner, wall portions 46 and 48 are sandwiched between clips 82, 83 and longitudinally extending members 76, 77 such that mullion 11 is secured to retainer 24.

After securing retainer 24 to mullion 11, tab 104 of retainer 24 is aligned with keyhole 36 in return flange 26. Next, laterally extending portion 86 of retainer 24 and lip 58 of mullion 11 are inserted into gap 38 between return and secondary flanges 29 and 30, while tab 104 is received within keyhole 36. The engagement of front facing surface 62 of lip 58 with return flange 29 results in a smooth outer appearance at the transition between mullion 11 and return flange 26.

Figure 6:
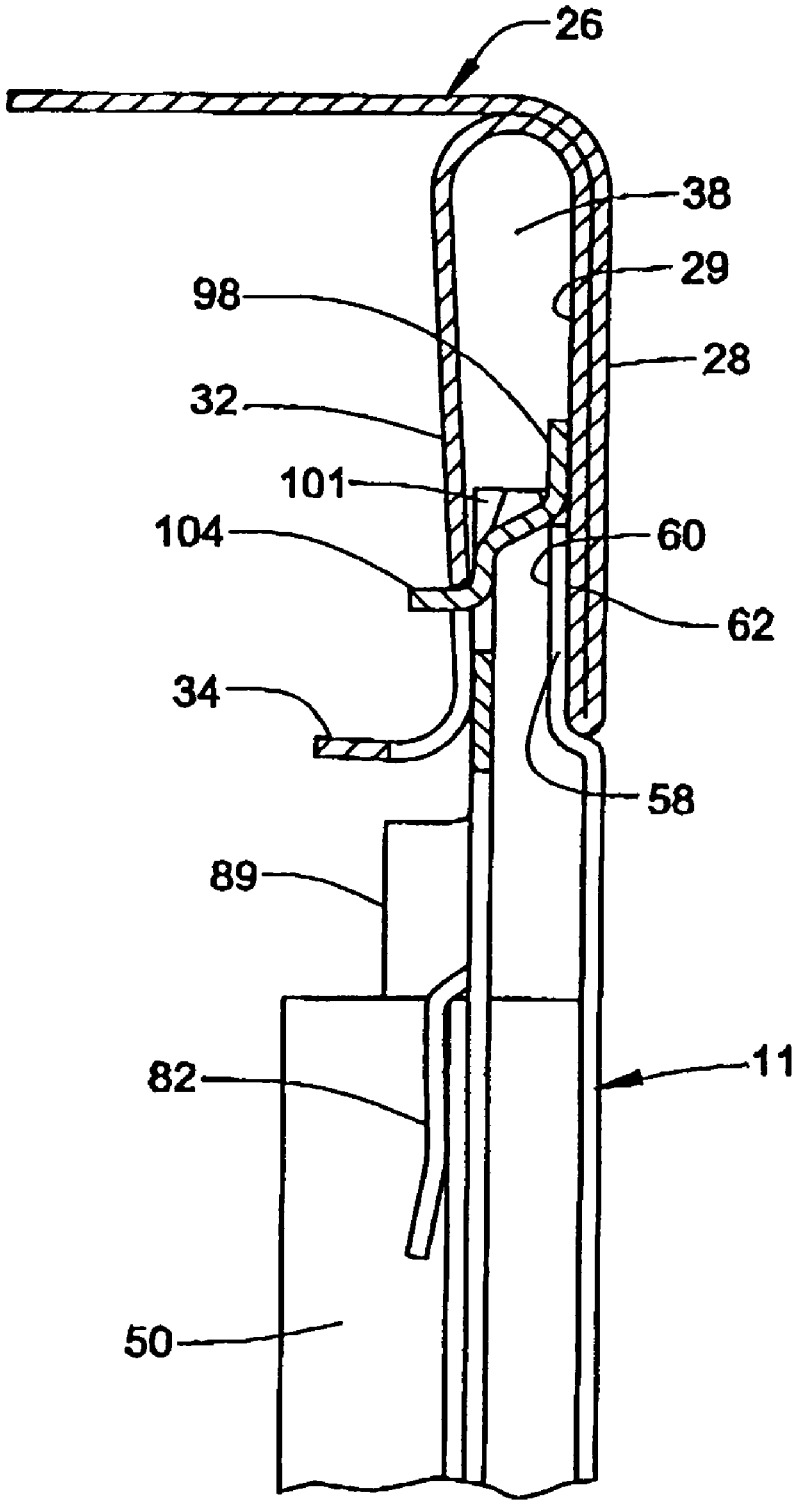
FIG. 6 is a cross-sectional side view of the assembled mullion retaining arrangement of FIG. 5.

As depicted in FIG. 6, the structure of retainer 24, including offset finger member 94 and the structure of offset lip 58 of mullion 11, provides a snug fit for the retainer 24/mullion 11 assembly within gap 38. Likewise, tab 104 is sized to fit snuggly in the upper part (not separately labeled) of keyhole 36. With this construction, mullion retainer 24 accurately positions mullion 11 with respect to outer shell 3, while preventing any relative horizontal or vertical movement between the mullion 11 and the outer shell 3. Furthermore, by reducing the potential for any gaps between outer shell 3 and mullion 11 through the use of mullion retainer 24, the present invention effectively eliminates any foam leakage in this overall region during insulation of refrigerator cabinet 1. More specifically, by maintaining conforming surfaces between flange structure 26, mullion retainer 24 and mullion 11, when the zone between outer shell 3 and the fresh food and freezer liners 20 and 21 is injected with insulation during a cabinet forming process, leakage of insulation material in this area of the refrigerator cabinet 1 is prevented.

Although described with reference to a preferred embodiment of the invention, it should be readily understood that various changes and/or modifications can be made to the invention without departing from the spirit thereof. For instance, the relative length of longitudinally extending members 76 and 77 and laterally extending portion 86 can vary from that shown in the drawings without departing from the spirit of the invention. In addition, although the invention has been described with reference to side-by-side refrigerator cabinet 1, the invention could also be employed in connecting a mullion for other types of refrigerators, including top and bottom-mount styles. In general, the invention is only intended to be limited by the scope of the following claims.

We claim:

1. A refrigerator comprising:

a cabinet shell including flange structure having at least a primary flange and a secondary flange separated by a gap, said secondary flange being formed with a keyhole;

a mullion including opposing first and second flange structures;

a retainer interconnecting the mullion to the cabinet shell, said retainer including a first body portion engaged with the mullion, a second body portion positioned in the gap and a tab, extending from the second body portion, received within the keyhole; and at least one clip member extending from the first body portion of the retainer, with said at least one clip member extending about a portion of the mullion to interconnect the retainer and the mullion.

2. The refrigerator according to claim 1, wherein the first body portion constitutes at least one longitudinally extending member and the second body portion constitutes a laterally extending member.

3. The refrigerator according to claim 2, wherein the at least one longitudinally extending member constitutes first and second spaced longitudinal members and the at least one clip member constitutes first and second clip members, with said first clip member projecting from the first longitudinal member and the second clip member projecting from the second longitudinal member.

4. The refrigerator according to claim 3, wherein the flange structures of the mullion define first and second elongated slots, said first and second longitudinal members being received in the first and second slots respectively.

5. The refrigerator according to claim 4, further comprising: a flange portion extending along each of the first and second longitudinal members laterally outwardly of a respective one of the first and second elongated slots.

6. The refrigerator according to claim 5, wherein the flange portion on each of the first and second longitudinal members extends into the laterally extending member.

7. A refrigerator comprising:

a cabinet shell including flange structure having at least a primary flange and a secondary flange separated by a gap, said secondary flange being formed with a keyhole;

a mullion including opposing first and second flange structures; and a retainer interconnecting the mullion to the cabinet shell, said retainer including a first body portion engaged with the mullion, a second body portion positioned in the gap and a tab, extending from the second body portion, received within the keyhole, wherein the second body portion of the retainer engages each of the primary and secondary flanges.

8. The refrigerator according to claim 7, wherein the second body portion is frictionally held between the primary and secondary flanges, while the tab is snugly received in the keyhole to substantially prevent lateral shifting of the mullion relative to the cabinet shell.

9. A refrigerator comprising:

a cabinet shell including flange structure having at least a primary flange and a secondary flange separated by a gap, said secondary flange being formed with a keyhole;

a mullion including opposing first and second flange structures;

a retainer interconnecting the mullion to the cabinet shell, said retainer including a first body portion engaged with the mullion, a second body portion positioned in the gap and a tab, extending from the second body portion, received within the keyhole; and a finger member projecting from the second body portion, with said finger member directly engaging the primary flange, while a section of the second body portion, spaced from the tab, directly engages the secondary flange, to interconnect the retainer to the cabinet shell.

10. The refrigerator according to claim 9, wherein the mullion further includes a lip portion that extends into the gap.

11. The refrigerator according to claim 10, wherein the lip portion is positioned directly below the finger member within the gap.

12. A retainer for interconnecting a mullion to a cabinet shell having primary and secondary flanges separated by a gap and a keyhole formed in the secondary flange comprising:

a first body portion adapted to engage the mullion;

a second body portion adapted to be positioned in the gap;

a tab, extending from the second body portion, adapted to be received within the keyhole; and at least one clip member extending from the first body portion of the retainer, with said at least one clip member being adapted to extend about a portion of the mullion to interconnect the retainer to the mullion, wherein the first body portion constitutes first and second longitudinally extending members, the second body portion constitutes a laterally extending member and the at least one clip member constitutes first and second clip members, with said first clip member projecting from the first longitudinal member and the second clip member projecting from the second longitudinal member.

13. A retainer for interconnecting a mullion to a cabinet shell having primary and secondary flanges separated by a gap and a keyhole formed in the secondary flange comprising:

a first body portion adapted to engage the mullion;

a second body portion adapted to be positioned in the gap;

a tab, extending from the second body portion, adapted to be received within the keyhole; and a finger member projecting from the second body portion, with said finger member being adapted to directly engage the primary flange, while a section of the second body portion, spaced from the tab, is adapted to directly engage the secondary flange, for interconnecting the retainer to the cabinet shell.

14. A method for interconnecting a mullion to a refrigerator cabinet shell comprising:

attaching a first body portion of a retainer to a mullion;

inserting a second body portion of the retainer in a gap defined between a primary flange and a secondary flange of a cabinet shell;

fitting a tab on the second body portion into a keyhole formed in the secondary flange concurrently with the insertion of the second body portion into the gap; and clipping at least one clip member on the first body portion of the retainer to the mullion, such that the at least one clip member extends about a portion of the mullion, upon attaching the first body portion of the retainer to the mullion.

15. The method of claim 14, further comprising: extending a lip portion on the mullion into the gap concurrently with the insertion of the second body portion of the retainer into the gap.

16. The method of claim 14, further comprising: abutting a finger member extending from the second body portion against the primary flange while inserting the second body portion into the gap.

* * * * *